United States Patent [19]

Reynolds

[11] Patent Number: 4,913,361

[45] Date of Patent: Apr. 3, 1990

[54] APPARATUS AND METHOD FOR REDUCING AGGLOMERATES TO A PREDETERMINED PARTICLE SIZE

[76] Inventor: Augustus T. Reynolds, 3300 Woodwardia Dr., Charlotte, N.C. 28210

[21] Appl. No.: 202,683

[22] Filed: Jun. 6, 1988

[51] Int. Cl.[4] ..... B02C 19/12

[52] U.S. Cl. ..... 241/259.2; 241/259; 241/259.3

[58] Field of Search ..... 241/37, 244, 259, 259.1, 241/259.2, 260.1, 199.12, 259.3, 73; 415/121 B, 133; 418/257, 258, 181, 29

[56] References Cited

U.S. PATENT DOCUMENTS

| | | | |
|---|---|---|---|
| 1,039,610 | 9/1912 | Straub . | |
| 2,781,729 | 2/1957 | Johnson et al. | 418/257 X |
| 2,991,948 | 7/1961 | Hummelen | 241/73 |
| 3,771,902 | 11/1973 | Bandy | 418/257 X |
| 3,806,050 | 4/1974 | Cumpston, Jr. | 241/260 |
| 3,823,878 | 7/1974 | Ishikura | 241/69 |
| 3,829,030 | 8/1974 | Wallenfang et al. | 241/89.1 |
| 4,044,596 | 8/1977 | Luce | 418/257 X |
| 4,071,198 | 1/1978 | Tetreault | 241/73 |
| 4,206,882 | 6/1980 | Barnes et al. | 241/221 |
| 4,218,024 | 8/1980 | Pallmann | 241/188 R |
| 4,275,852 | 6/1981 | Asplund | 241/259.2 |
| 4,377,110 | 3/1983 | Matsumoto | 99/489 |
| 4,614,304 | 9/1986 | Reinhall et al. | 241/28 |
| 4,614,310 | 9/1986 | Tloczynski et al. | 241/259 |

OTHER PUBLICATIONS

Publication "From the Drum Mill to the Annular Chamber Mill" Trends and developments regarding dispersion and grinding techniques in the paint and lacquer industry, Mr. Willie John–date unknown.

*Primary Examiner*—Joseph M. Gorski

*Attorney, Agent, or Firm*—W. Thad Adams, III

[57] ABSTRACT

Grinding of agglomerates, such as paint pigments, takes place within a cylinder (23). The pigment is applied in a film to the inner surface of cylinder (23) and is ground by rotating blades (70–84) which, because of their angle of articulation with respect to the axis of rotation of the cylinder (23) moves the agglomerates from one end of cylinder (23) to the other.

8 Claims, 9 Drawing Sheets

APPARATUS AND METHOD FOR REDUCING AGGLOMERATES TO A PREDETERMINED PARTICLE SIZE

TECHNICAL FIELD AND BACKGROUND OF THE INVENTION

This invention relates to an apparatus and method for reducing agglomerates to a predetermined particle size. Such a process is generally distinguished from processes akin to pulverizing both in the manner in which the reduction of particle size takes place and in the end product. The process to which this invention relates is sometimes referred to as grinding or milling. The purpose of these processes is to arrive at a product having a relatively uniform microfine particle size.

Many different types of agglomerates are processed in this type of machine. Examples include paint and ink pigments, barium, manganese, zinc ferrite and, in the food processing industry, products such as coffee and cocoa.

There are two basic prior art processes for grinding or milling agglomerates to reduce their particle size.

One of these processes uses an apparatus variously referred to as an annular chamber mill, grinding mill, agitator mill or peg mill. Development of this type of machine began with a hollow cylinder rotating on a horizontal axis and loaded with a certain amount of material to be ground and a certain quantity of grinding elements—most commonly small spherical steel balls but sometimes other hard substances such as walnut shells. The rotation of the cylinder causes the balls to tumble over and collide with each other in layers, grinding the material as the balls collide with each other. Typically, the loads were fed into the cylinder and ground for a period of six to sixty hours, depending on the size of the agglomerate and the desired size of the ground particles.

Next, vertical and horizontal agitator mills were developed by using a slow-running agitator to keep the ball charge moving. As with the horizontal tube mill, the vertical agitator mill operated periodically. During operation, a pump drew off the ground material at the bottom of the mill and pumped it back in at the top to make sure that it was uniformly processed.

More recently, particular attention has been paid to the shape and operation of the design of the agitators which keeps the ball charge activated. It was recognized that two out of the three factors which influence the grinding effect can be easily held constant. These are the size of the contact surface and the mass of the grinding balls. Therefore, the speed of the agitator arms, which sets the grinding elements in motion can be made to vary and thereby control operating parameters. Through development it was determined that the most efficient way of keeping the balls in motion is by the use of pegs which rotate through the ball charge. This led to the development of the annular chamber mill or peg mill of current design.

In current-style peg mills, the agitator is designed as a hollow shaft with a relatively large diameter. Pegs project outwardly from the shaft. The pegs are kept relatively short to limit the difference in speed between the hollow shaft and the extreme ends of the pegs. These pegs are arranged in rings on the hollow shaft, one above the other at relatively short intervals.

Also located in rings around the inside walls of the grinding tank are counter-pegs which fit between the pegs circulating on the agitator shaft. The purpose of the counter-pegs is to make sure that the grinding elements are thoroughly activated. Since the diameter of the grinding tank is relatively large and since up to eight agitator pegs are arranged in one annular element, the agitator shaft can be driven at a slow speed. The pegs are typically manufactured from material such as tungsten carbide in an effort to reduce wear. Nevertheless, the massive amounts of friction created between the material being ground, the grinding elements and the pegs generate a tremendous amount of heat and wear out the moving parts at a relatively rapid rate even at very slow speed. Furthermore, the physics involved in explaining the manner in which material is ground in peg mills is a complex one. In some cases, grinding is carried out most effectively in the lower part of the grinding tank. In other instances, grinding occurs most effectively in the top of the grinding tank or somewhere in between, depending on the throughput and the viscosity of the material being ground. Care must therefore be taken to control the throughput rate and the grinding rate to insure that the mill does not overheat and that the material is completely and uniformly ground To deal with the heat generated in peg mills, cooling jackets are provided which encircle the periphery of the grinding tank and also extend upwardly through the hollow shaft on which the inner grinding pegs are located. Cold water is circulated through these jackets in order to maintain temperature within the grinding tank within established limits. However, uniform cooling in this type of apparatus is impossible. As is apparent, the most efficient cooling will take place at the surface of the cooling jackets. Therefore, product which is in contact with the cooling jackets will be cooled to a very substantial degree, while material in the middle of the ball charge and between the inner and outer cooling jackets will be cooled to a much lower degree, if at all. Since some types of materials, such as some paint pigments and food products, are quickly affected by heat, it is apparent that the relatively efficient cooling next to the cooling jackets and the relatively inefficient cooling in the middle of the grinding area of the grinding tank has the potential for creating an end product which is an average of individual particles having distinctly different characteristics due to heat variation.

To summarize, a state-of-the-art peg mill such as described above provides continuous throughput with a relatively high output of ground product. These advantages are off-set by difficulty in uniformly cooling the product being ground and a relatively uneven particle size in relation to other types of grinding. Finally, the ball mill is very difficult to clean because of the vast amount of surface area contained on the balls, the pegs and the shaft and grinding tank walls. Therefore, it is quite often necessary to use a particular mill for only a single substance. This is particularly true when grinding pigments for paints where contamination of pigments of one color by pigments of another color results in an unusable end product.

The second type of grinding mill is known as a roller mill. In this type of mill, grinding takes place by shearing the material between closely spaced-apart cylindrical rolls rotating at different speeds. This type of mill cannot be used for continuous throughput but, rather, is used to grind a single charge of product. At the beginning of the process, the rolls are slightly spaced-apart. The charge of material to be ground is applied to the rolls and spread on the rolls until an even coating covers all of the rolls. Then, the rolls are moved together. The differential speed of rotation of the rolls causes the product to be ground through the shearing action of one roll against the material coating the adjacent roll.

A roller mill offers the advantage of very uniform cooling since a very thin film of material is always in contact with the surface of the roll which is cooled by circulating water or another heat absorbing medium. Also, the rolls of the roller mill are relatively easy to clean in relation to the peg mill described above. Therefore, the roller mill can be cleaned and used to grind a variety of substances, including different paint and ink pigments. While the roller mill offers these advantages, it also cannot be used for continuous throughput of material and has a relatively low rate of material output. In addition, the roller mill is open to the user and therefore dangerous since fingers, hair, neckties, etc. can be caught in the rapidly rotating rolls.

The two types of mills described above have been used for many years in spite of the fact that they both offer significant disadvantages. In many cases, a choice of which of the two mills to use depends on which disadvantages are acceptable and are most easily compensated for by their respective advantages.

The invention described in this application eliminates all of the disadvantages described above for the roller mill and the peg mill while retaining their advantages. Specifically, the invention described below is a continuous throughput mill which, like the roller mill described above, achieves very efficient cooling of the product. For this reason, a very high output of ground product can be achieved. The apparatus is easy to clean and produces an output material having a very even particle size.

SUMMARY OF THE INVENTION

Therefore, it is an object of the invention to provide an apparatus and method for reducing agglomerates to a predetermined particle size.

It is another object of the present invention to provide an apparatus and method for reducing agglomerates to a predetermined particle size which operates with a continuous throughput of material to be ground.

It is another object of the invention to provide an apparatus and method which achieves efficient and uniform cooling of the material being ground.

It is yet another object of the invention to provide an apparatus and method which produces an output material having an even particle size.

These and other objects and advantages of the invention are achieved by providing an apparatus for reducing agglomerates to a predetermined particle size which includes a tank defining a cylindrical inner wall for carrying on its surface a coating of agglomerates. The tank is provided with a material inlet and a material outlet. A rotor is mounted in the tank for relative concentric rotation and a plurality of elongate rotor blades are carried on the rotor for rotation therewith. Each blade defines a tangential forward longitudinally extending surface for shearing contact with the layer of agglomerates coating the inner wall of the tank.

The distance between the forward surface of the blade and the inner wall of the tank is controlled to thereby control the particle size to which the agglomerates are reduced. Preferably, the rotor defines a plurality of longitudinally extending sides, with a plurality of blades carried on each side.

In the embodiment of the invention described herein, adjacent blades carried on the same side of the rotor are positioned in partially overlapping relation whereby the surface contact of the blades on the inner wall of the tank overlaps.

The tangential forward surface of each blade defines a helix segment in relation to the inner wall of the tank for moving the agglomerate axially and rotationally along the inner wall of the tank as the blades rotate.

The material inlet and material outlet are axially spaced-apart and the blade helix segments are positioned to move material from the proximity of the material inlet to the proximity of the material outlet as the blades rotate.

In accordance with another embodiment of the invention, the apparatus for reducing agglomerates to a predetermined particle size comprises a tank defining a cylindrical inner wall for carrying on its surface a coating of agglomerates. The tank includes a material inlet and a material outlet. A rotor is rotatably mounted in the tank for relative concentric rotation therein and a plurality of elongate rotor blades are carried on the rotor for rotation therewith. Each blade defines a tangential forward surface for shearing contact with the layer of agglomerates coating the inner wall of the tank. The distance between the forward surface of the blades and the inner wall of the tank is controlled by pressure to thereby control the particle size to which the agglomerates are reduced.

In accordance with this embodiment of the invention, each of the blades is carried by a rotor blade holder carried on the rotor. Each of the rotor blade holders comprises an elongate body having an elongate slot therein adapted to receive one of the blades and hold the blade with the forward surface of the blade projecting outwardly toward the inner wall of the tank. Pressure is provided from a pressure source which communicates with at least one piston carried for restricted inward and outward movement in a suitably sized piston bore in the blade holder and responsive to an increase in pressure for outward movement of the blade towards the agglomerate coated wall and into contact with the agglomerate and responsive to a decrease in pressure for opposite inner movement of the blade away from the agglomerate coated wall.

Preferably, pressure is provided by a hydraulic fluid carrying line operatively connected to a hydraulic pump.

Biasing means are provided for normally urging the blade inwardly away from the agglomerate coated wall, the pressure being sufficient to overcome the biasing means in order to move the blade outwardly towards the agglomerate coated wall and into contact with the agglomerates.

Preferably, the biasing means comprises a spring support stationarily secured to a suitably sized seat in the piston bore in spaced-apart relation to the piston and a Belville washer positioned in compressed relation between the spring support and the enlarged head of a bolt secured to the blade for normally urging the bolt and the blade secured thereto away from contact with the inner wall.

In accordance with the method of the invention, an agglomerate is applied to the inner wall of a cylindrical tank and blades move against the inner wall of the cylindrical tank and exert a shearing force against the agglomerates

BRIEF DESCRIPTION OF THE DRAWINGS

Some of the objects of the invention have been set forth above. Other objects and advantages of the invention will appear as the description of the invention proceeds when taken in conjunction with the following drawings, in which.

DESCRIPTION OF THE PREFERRED EMBODIMENT

Figure 1:
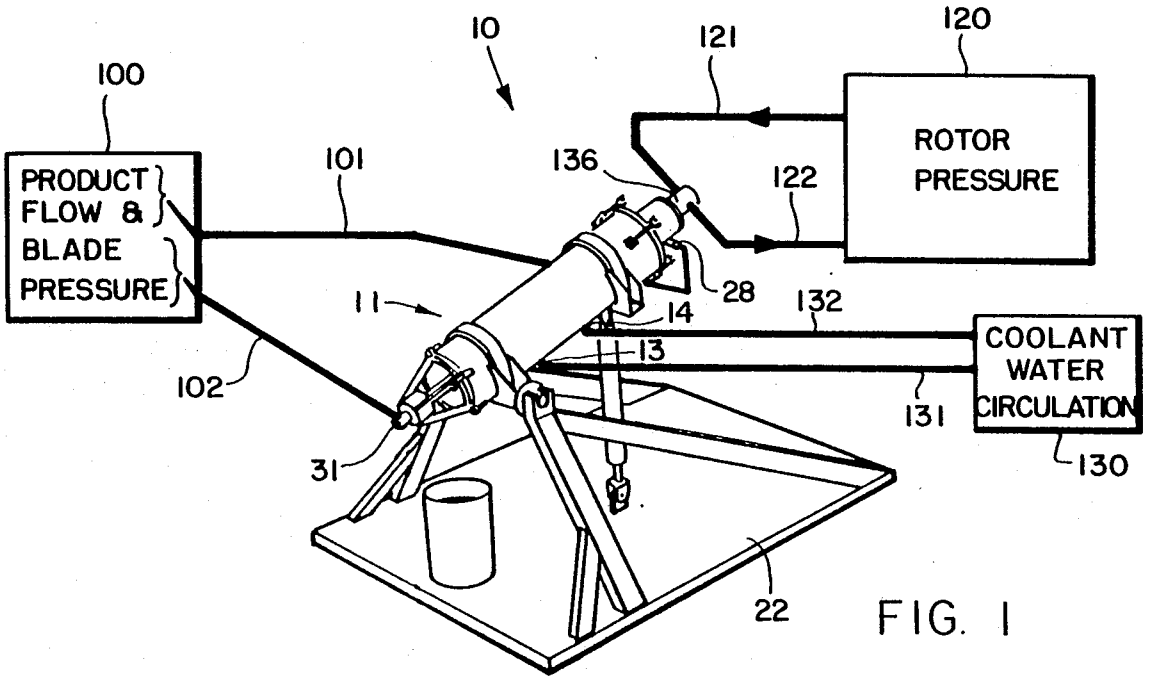
FIG. 1 is a perspective view of the guiding tank according to the present invention with the tank controls shown in block form.

Referring now specifically to the drawings, an apparatus for reducing agglomerates to a predetermined particle size, which will be referred to in this application as a "mill", is shown and generally designated at reference numeral 10.

FIG. 1 illustrates mill 10 in a partially schematic manner so that its primary physical components can be seen and easily understood. The description of the invention will proceed with initial reference to the grinding tank 11, with description of the control elements of the invention, the product and blade pressure system 100, rotor pressure system 120 and coolant water circulation system 130, as shown in FIG. 1, proceeding as is necessary to relate their operation to grinding tank 11.

Figure 2:
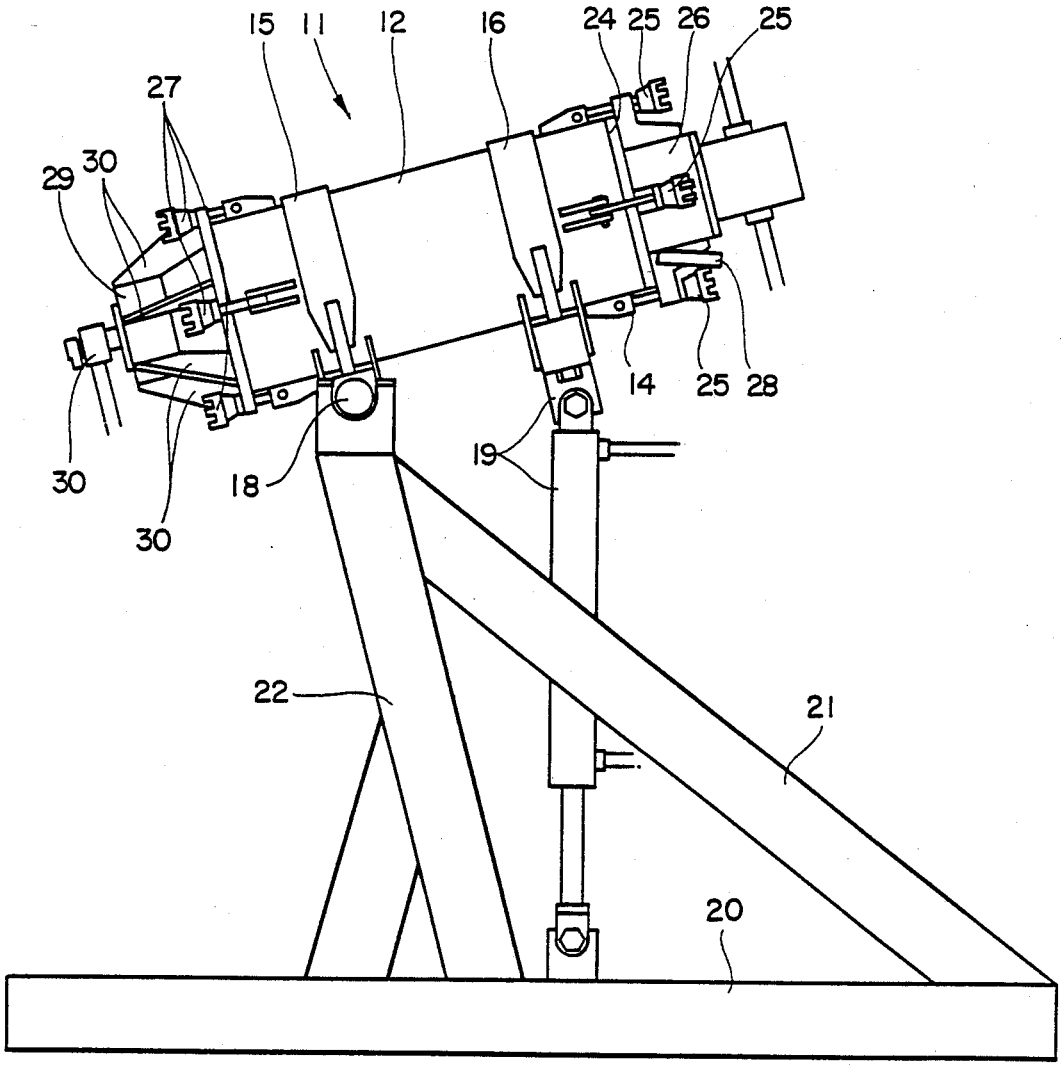
FIG. 2 is a side elevation view of the grinding tank shown in FIG. 1.

Referring now to FIG. 2, grinding tank 11 includes an outer coolant cooling jacket 12 having a water inlet 13 and a water outlet 14. Water is circulated through water jacket 12 by utility system pressure in order to absorb and carry off heat generated by operation of grinding tank 11.

Grinding tank 11 is mounted by means of two spaced-apart annular collars 15 and 16 on a trunion 18 and a hydraulic tilt mechanism 19. Trunion 18 is supported above a base 20 by pairs of legs 21 and 22. Water jacket 12 is positioned around a tank, which comprises a cylinder 23 (see FIG. 3). Cylinder 23 and water jacket 12 are enclosed on one end by an end cap 24. End cap 24 is secured to water jacket 12 and cylinder 23 by means of a plurality of tie rod fasteners 25. End cap 24 also supports a bearing housing 26. A product inlet 28 communicates through end cap 26 and introduces product to be ground into cylinder 23.

The other end of cylinder 23 is open and forms the discharge end. A bearing housing 29 is supported in axially spaced-apart relation from and secured to cylinder 23 and water jacket 12 by means of leg braces 30 and tie rod fasteners 27. A rotary union 31 is carried outboard of and concentric with bearing housing 29.

Figure 3:
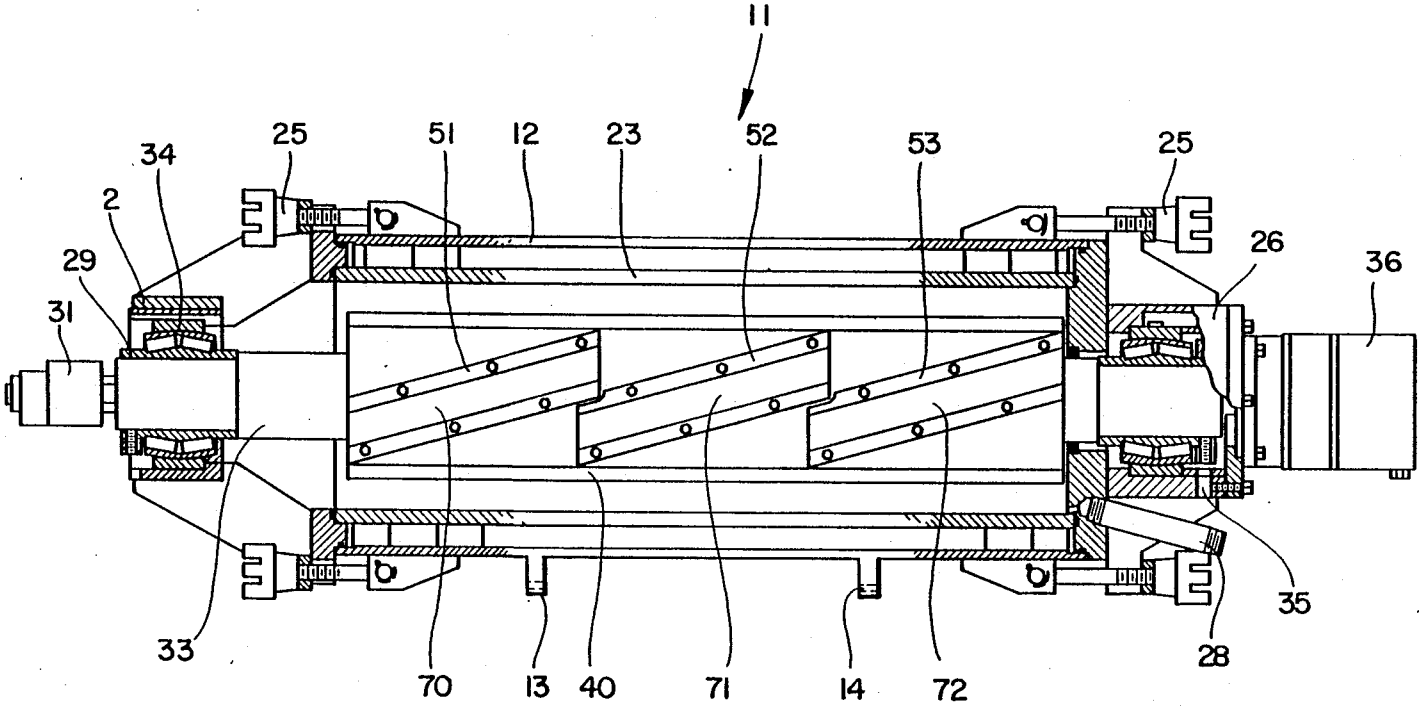
FIG. 3 is a cross-sectional view of the grinding tank shown in FIG. 2.

As is shown in FIG. 3, cylinder 23 is positioned concentrically within water jacket 12. A hollow shaft 33 is mounted for rotation within cylinder 23 by means of the bearing housings 26 and 29. Bearing housings 26 and 29 contain, respectively, self-aligning pillow blocks and bearings 34 and 35. Shaft 23 is rotated by a hydraulic motor 36 mounted outboard of bearing housing 26.

Cylinder 23 is fabricated of high strength chromium D-2 tool steel and has a precisely machined and smoothly polished inner wall. As will be apparent below, the accuracy with which the cylinder 23 is prepared will determine in large measure the quality of the agglomerates ground in the grinding tank 11.

Figure 4:
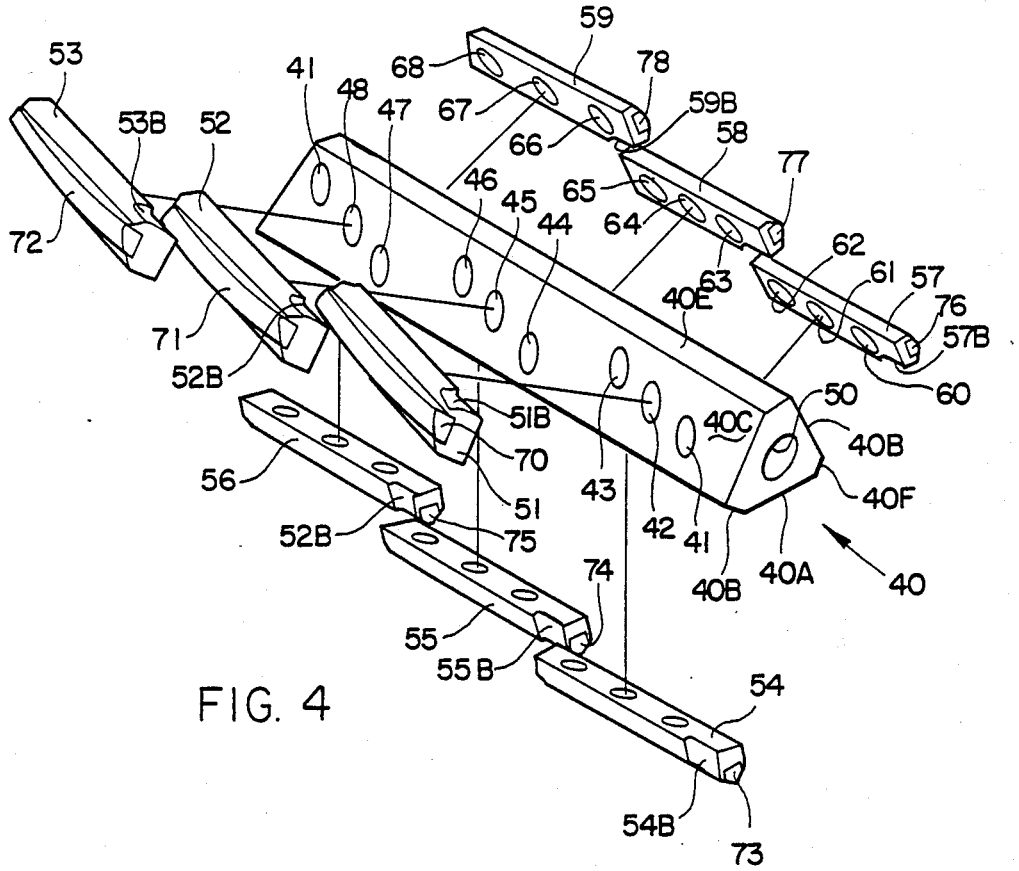
FIG. 4 is an exploded view, with parts omitted for clarity, of the rotor, rotor blade and rotor blade holder assembly.

Still referring to FIG. 3, a rotor 40 is fixedly secured on shaft 33 for unison rotation. As is shown in FIG. 4, rotor 40 is substantially triangular in cross-section and includes three primary faces 40A, 40B and 40C. Rotor 40 also includes three secondary faces 40D, 40E and 40F. These faces are formed primarily to reduce the weight of the rotor. Therefore, the rotor will be referred to as triangular even though the secondary faces 40D through 40F are present. Faces 40A, 40B and 40C each include nine rotor piston bores 41–49. These bores 41–49 are arranged diagonally in groups of three. Rotor 40 also includes a central bore 50 into which hollow shaft 33 is positioned.

Nine blade holders 51–59 are mounted on rotor 40. As is shown in FIG. 4, three rotors are positioned on each of three faces 40A–40C of rotor 40. Blade holder piston bores 60–68 are formed in groups of three on blade holders 51 through 59. Therefore, there are twenty-seven rotor piston bores in rotor 40 and twenty-seven mating blade holder piston bores 60–68 in blade holders 51–59. As is illustrated in FIG. 4, the rotor piston bores 41–49 in rotor 40 mate with blade holder piston bores 60–68 in blade holders 51–59 to form a chamber within which a piston resides, as is described in more detail below.

Figure 6:
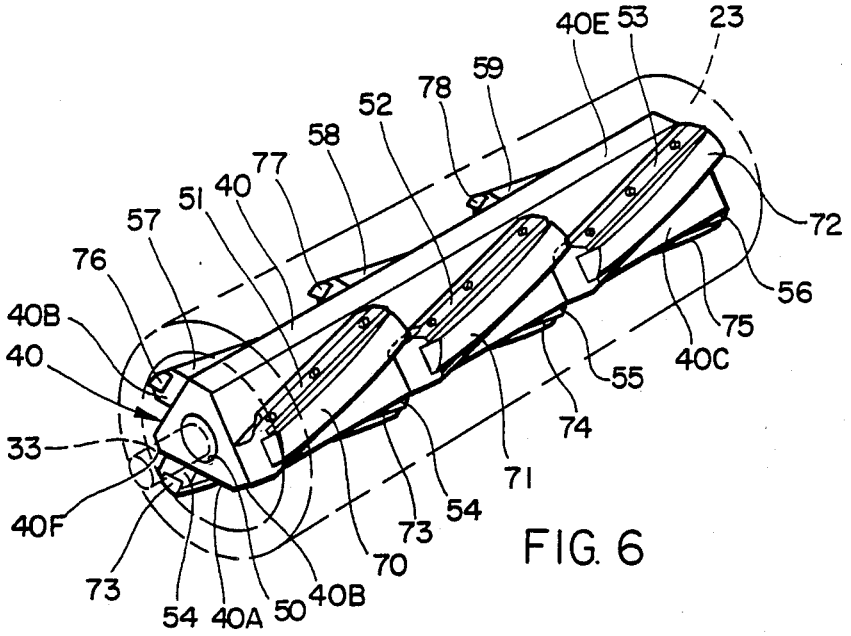
FIG. 6 is a perspective view of the rotor, rotor blade holder and rotor assembly according to the invention shown in orientation with the cylinder of the grinding tank.
Figure 5:
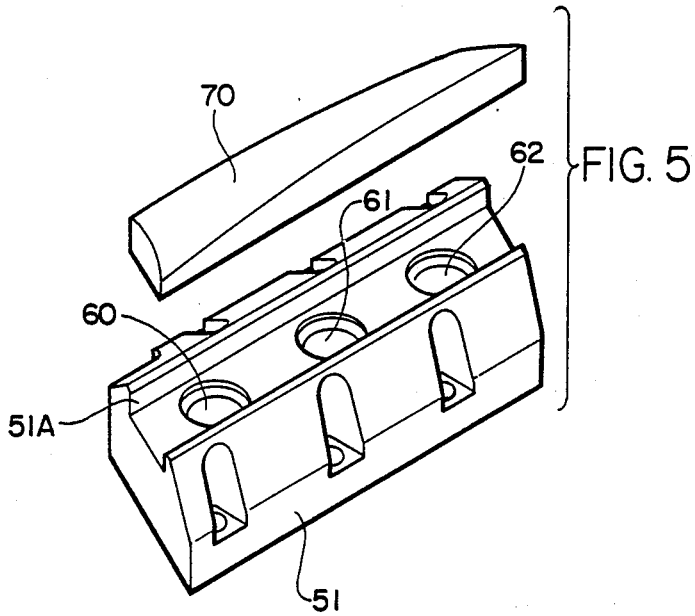
FIG. 5 is an exploded view of a single rotor blade and rotor blade holder.

Blade holders 51–59 each have a longitudinally extending channel 51A–59A, respectively, machined into one face. Blades 70–78 are positioned in channels 51A–59A, respectively. Blades 70–78 are machined from the same type of steel as cylinder 23. The blade holders 51–59 are positioned on faces 40A–40C of rotor 40 in an overlapping, tangential direction as is shown in FIGS. 3, 4 and 6. Note that blade holders 51–59 are provided with cutouts 51B–59B. This permits adjacent blade holders to be placed very close to each other in overlapping relation. This relationship is best shown in FIGS. 3 and 6.

Further structure of the blade holders 51–59 and blades 70–78 will be described with reference to FIGS. 5 through 9. Since all of the blade holders 51–59 and blades 70–78 function identically, further description of these elements will proceed where possible with reference to a single blade holder 51 and blade 70, it being understood that the description relates to like elements as well.

Blade 70 is constructed to fit within channel 51A of blade holder 51. The outwardly extending face of blade 70 defines a longitudinally-extending surface for shearing contact with the layer of agglomerates coating the inner wall of cylinder 23. Note that the surface of the blade is curved in cross-section and along its longitudinal length. The purpose of this construction is to permit the curved blade to nevertheless be exactly parallel with the inner wall of cylinder 23 along its entire length and throughout its entire 360 degrees of rotation on rotor 40. The necessity and purpose of the shape of blade 70 can best be understood by first hypothesizing that a blade holder and blade are mounted in axially extending longitudinal alignment with the axis of rotation of rotor 40 and the concentric axis of cylinder 23. With this configuration, blade 70 could be perfectly straight in the longitudinal direction and still contact the inner surface of cylinder 23 along its entire length. However, by moving blade holder 51 out of axial alignment with the axis of rotation of rotor 40, a straight blade such as described immediately above would contact the inner wall of cylinder 23 only at each end. This can be visualized by imagining a cylinder, open on both ends, lying horizontally with a straight object, such as a pencil, lying in and through it from one end to the other in axial alignment. If both the pencil and the cylinder are straight, then, when in axial alignment, contact is made along the entire length of the cylinder and pencil. However, if the longitudinal axis of the pencil is rotated while still maintaining contact between the pencil and opposite ends of the cylinder, a progressively enlarged space appears between the pencil and cylinder, with the greatest distance between the two being at the point of rotation of the pencil relative to the cylinder. If the shape of the pencil is then altered to provide intimate contact between the pencil and cylinder along their entire lengths at this particular tangent, then intimate contact can be maintained even when the pencil is rotated within the cylinder, assuming the angle of tangent remains the same.

Figure 7:
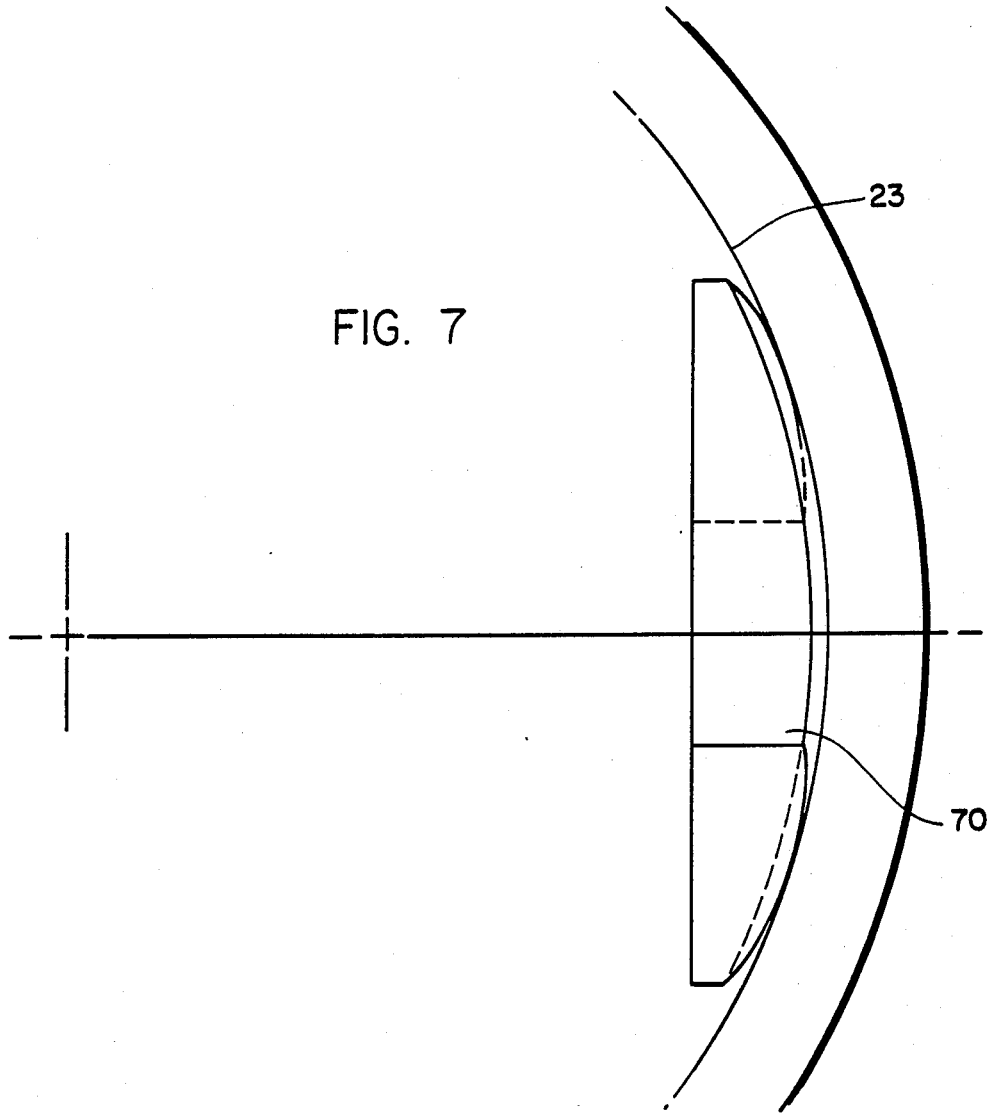
FIG. 7 is a schematic view showing the manner of contact between a single blade and the inner agglomerate carrying wall of the cylinder of the grinding tank.
Figure 8:
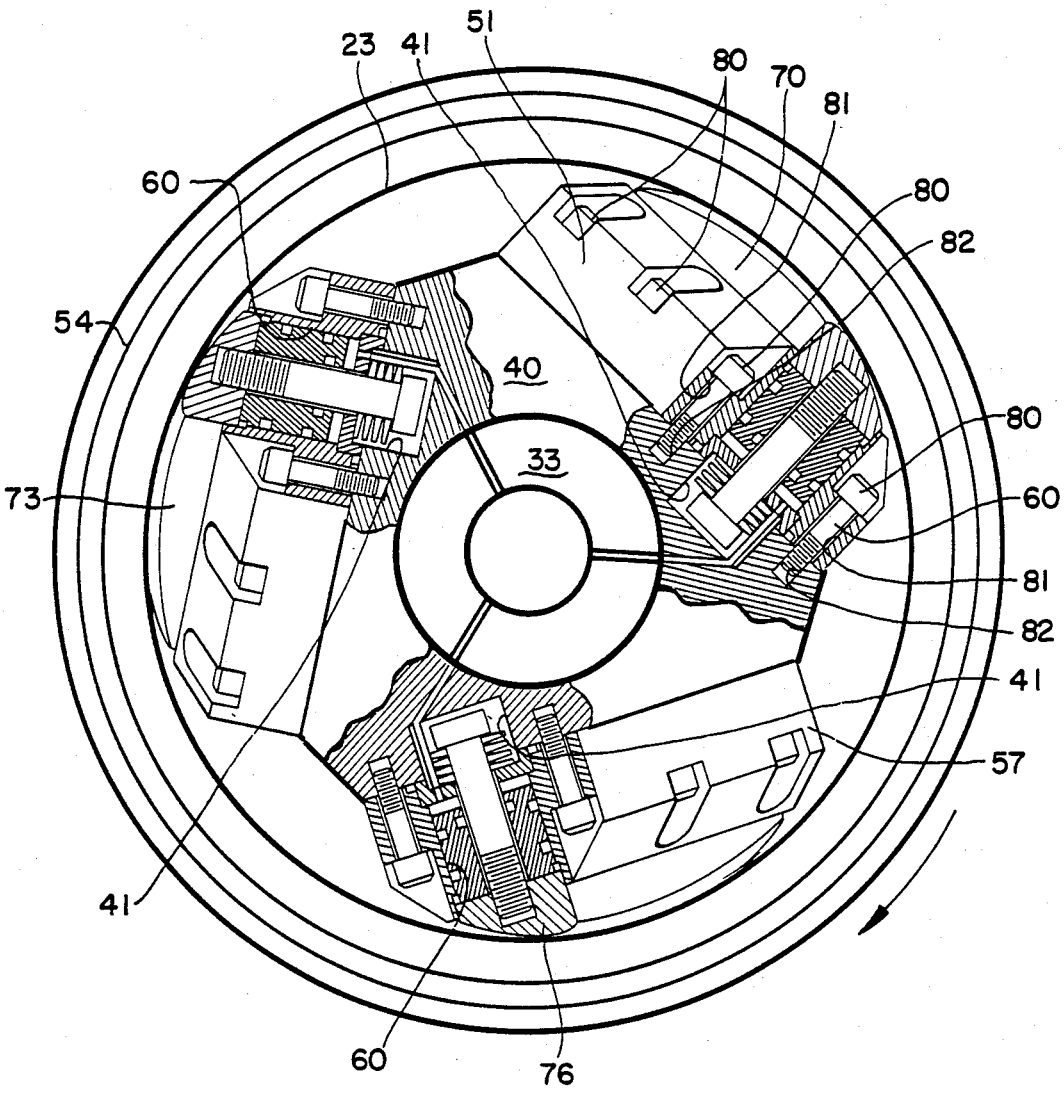
FIG. 8 is a partial cross-sectional view of the grinding tank.
Figure 9:
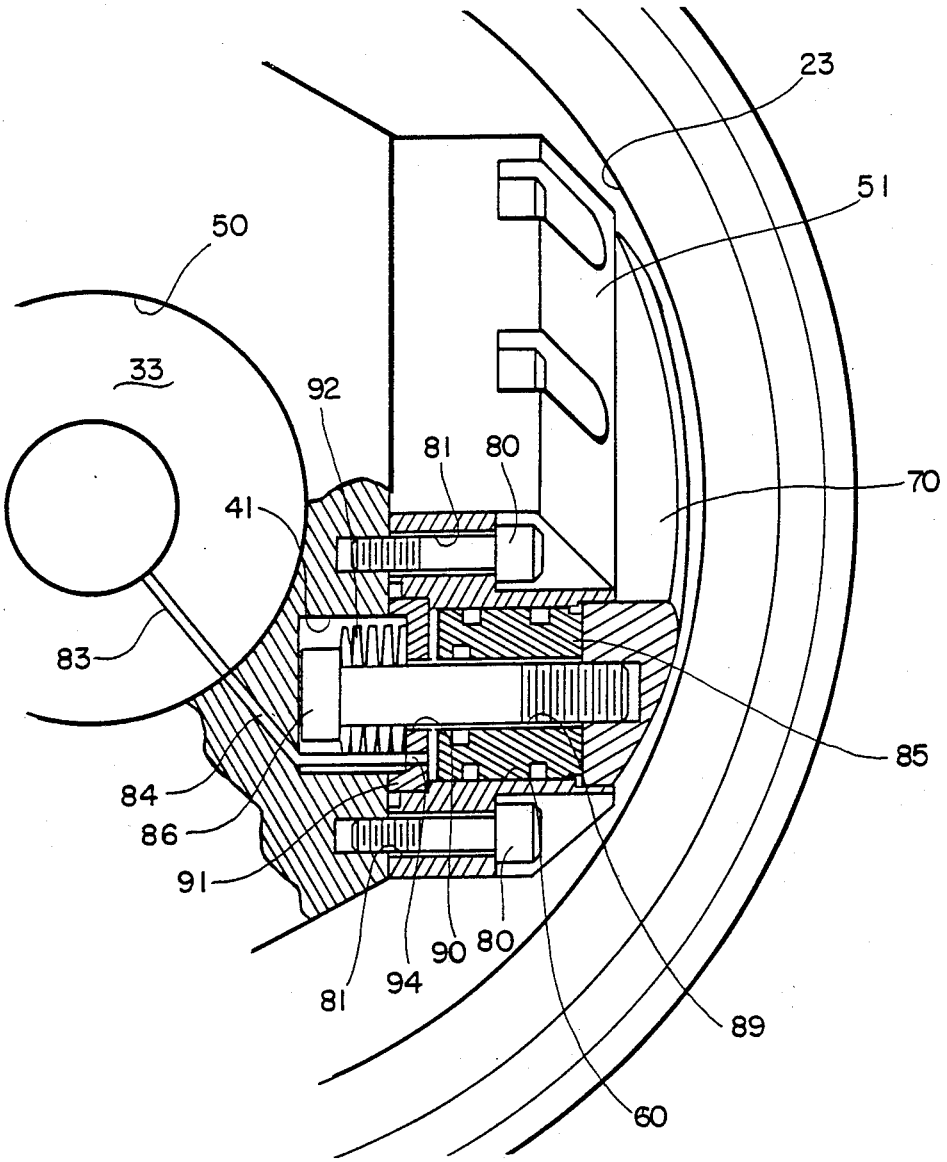
FIG. 9 is a fragmentary enlarged view of one of the blade holder assemblies shown in FIG. 8.

The same principle operates in connection with blade 70. It should be emphasized that blade 70 is symmetrical in cross-section only at its mid-point, and then only when the section is taken perpendicular to its longitudinal axis. Elsewhere along the length of blade 70, an asymmetrical relationship is defined which is dependent on a number of factors, including the radius of cylinder 23 in relation to the width of blade 70 and the angle at which blade 70 is tangent to the longitudinal axis of cylinder 23.. In the example shown in this application, blade 70 is 15 degrees, 17 minutes tangent to the longitudinal axis of cylinder 23. The contact all along the length of blade 70 is best shown in FIGS. 7, 8 and 9. The point of contact of blade 70 along cylinder 23 defines a helix segment.

Referring specifically to FIG. 8, the cross-sectional view serves to illustrate the relationship of the three faces of rotor 40 with relation to each other and to cylinder 23. Note that the blade holders 51, 54 and 57 are secured to rotor 40 by bolts 80 which extend through oversized bolt holes 81 therein and are threaded into bolt holes 82 formed in faces 40A–40C of rotor 40.

Referring now to FIG. 9, the blade pressure hydraulic system, again with reference only to a single blade holder 51 and blade 70 is explained. A port 83 in shaft 33 and a port 84 in rotor 40 are mated by alignment of shaft 33 with rotor 40 to define a fluid pressure port 83/84. Fluid pressure port 83/84 communicates with rotor piston bore 41 and transmits hydraulic fluid under pressure from hollow shaft 33. As described above, rotor piston bore 41 and blade holder piston bore 60 are mated to define a pressure chamber 95. A piston 85 is positioned within blade holder piston bore 60 in fluid sealing engagement therewith for restricted movement therein. A retract bolt 86 is threaded into a bolt hole 88 in the back surface of blade 70, extends through a bore 89 in piston 85 and through a bore 90 in a spring support member 91.

A retract spring 92, preferably comprising a Bellville washer, is positioned within rotor piston bore 41. One end of retract spring 92 is biased against the enlarged head of bolt 86 and the other end of retract spring 92 is biased against the adjacent surface of spring support 91. Accordingly, bolt 86 is biased in the direction of shaft 33 and therefore normally holds blade 70 in a retracted position away from cylinder 23. Fluid pressure port 83/84 communicates through a port 94 in spring support 91. Therefore, hydraulic fluid is introduced into a space between the rear wall of piston 85 and the adjacent wall of spring support 91. Note also that bore 89 in piston 85 is oversized relative to the outside diameter of bolt 86, thereby permitting piston 85 to freely move for a restricted distance along the length of bolt 86. Hydraulic pressure within chamber 95 therefore urges piston 85 outwardly against the counter pressure of retract spring 92, causing blade 70 towards the inner wall of cylinder 23. Since all twenty-seven pistons 85 are operated in the same manner, all nine blade holders 51–59 are simultaneously urged outwardly, causing blades 70–78 to simultaneously contact the inner wall of cylinder 23.

Now that grinding tank 11 has been fully described, reference is again made to FIG. 1 for a further description of the entire grinding mill 10. The product is supplied to grinding tank 11 and pressure is supplied to blades 70–78 by the product and blade pressure system 100. The product is supplied to product inlet 28 by means of a product conduit 101. Hydraulic fluid is supplied to rotary union 31 through a hydraulic hose 102.

Rotor 40 is rotated with shaft 33 by the rotor pressure system 120. Hydraulic fluid is supplied to rotor drive motor 36 through a supply hose 121 and returned to rotor pressure system 120 through a return hose 122.

Cooling water is circulated through water jacket 12 by coolant water circulation system 130. A delivery hose 131 delivers cooling water from a pump (not shown) to water inlet 13. Water exits water jacket 12 through water outlet 14 to the coolant water circulation system by a hose 132.

Figure 10:
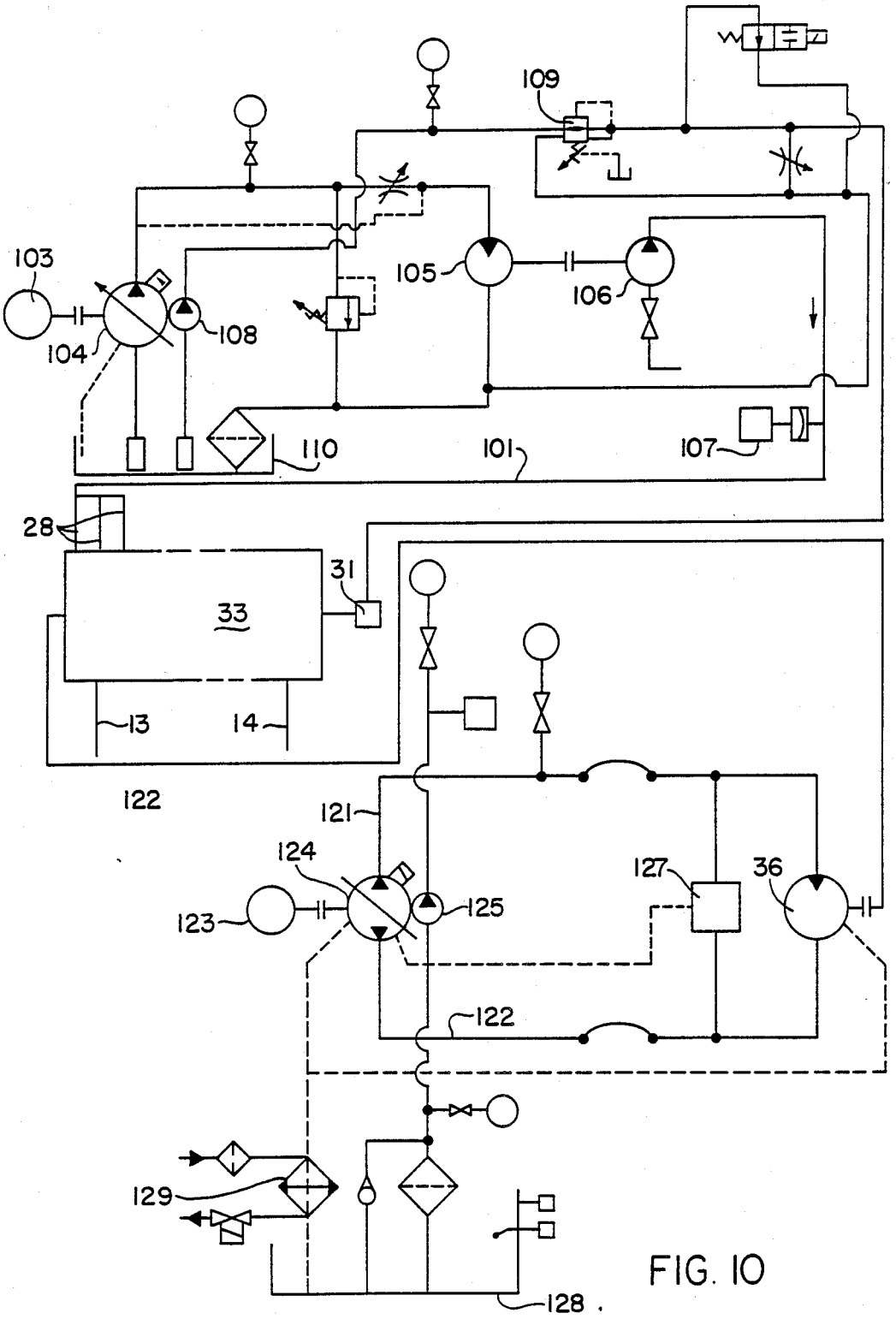
FIG. 10 is a hydraulic schematic of the invention.

The hydraulic system of mill 10 represented by product and blade pressure system 100 and rotor pressure 120 is now described in further detail with reference to FIG. 10. Power is supplied by a 10 horsepower electric motor 103 which drives a product drive pump 104. Product drive pump 104 in turn powers a hydraulic product drive motor 105 which powers a product pump 106. Product to be ground is taken from a supply (not shown) and delivered to product inlet 28 through product conduit 101, as described above. Product pump 106 will deliver product at the rate of between 0 and 4 gallons per minute. Product pressure is monitored at a product pressure gauge 107 in fluid communication with product conduit 101.

Motor 103 also powers a blade pressure pump 108. Hydraulic fluid pressure from blade pressure pump 108 is controlled at a rotor blade pressure reducing valve 109. Hydraulic fluid from blade pressure pump 108 is delivered to main shaft 33 through hydraulic hose 102 through rotory coupling 31.

Product and blade pressure system 100 is an open loop type system with hydraulic fluid supplied from a hydraulic fluid tank 110.

Rotor pressure system 120 is powered by a 50 horsepower electric motor 123 which drives a main shaft hydraulic drive pump 124. Main shaft hydraulic drive pump 124 also powers a charge pressure pump 125.

Main shaft hydraulic drive pump 124 is reversible. In the ordinary direction of rotation, supply hose 121 delivers hydraulic fluid under pressure to rotor drive motor 36 which rotates shaft 33 and the rotor 40 thereon. Fluid is returned to main shaft hydraulic drive pump 124 through return hose 122. Drive pump 124 is provided with a stall and inertia protective valve 127 which is connected in parallel hydraulic circuit relation with rotor drive motor 36. Rotor pressure system 120 is a closed-loop hydraulic system with hydraulic fluid supplied from a hydraulic supply tank 128. The speed of rotation of rotor 40 is variable and will typically be between 500 and 900 rpm. This rate of speed generates sufficient heat in the hydraulic fluid so that a hydraulic fluid cooler 129 is desirable.

Hydraulic power to the hydraulic tilt mechanism 19 can be supplied through a branch system off of product and blade pressure system 100 or through a separate system.

The coolant water circulation system 130 is completely conventional and further description is considered unnecessary.

The raw material for grinding mill 10 is an agglomerate, the particle size of which needs to be substantially reduced to a uniform consistency. A typical agglomerate of the type processed on grinding mill 10 is ink pigment. For example, black ink pigment is manufactured from carbon black, an amorphous form of carbon produced commercially by thermal or oxidative decomposition of hydrocarbons. Because of the number of variables involved in its production, the physical properties of carbon black extend across a significant range. For example, the surface area of raw carbon black can range from 10 to 150 square meters per gram (when determined by the nitrogen absorption method). The ultimate black particle has an average diameter of 20 to 300 millimicrons. However, pigment grade blacks must have a surface area of from 300 to 500 square meters per gram. In addition, the ultimate black carbon particles which form the ink pigment must be substantially uniform in size. It is therefore essential to reduce the agglomerated carbon black particles down to the desirable range for pigments specified above. Since carbon black is a dry substance, it must be dispersed in a vehicle for processing. Normally, unprocessed carbon black is mixed with oil to form a viscous liquid having a matte tar-like appearance. This product forms the raw material for grinding mill 10. This product is pumped through product supply conduit 101 to product inlet 28. As is shown in FIGS. 1 and 2, the grinding tank 11 is tilted with the inlet end somewhat higher than the outlet end. Before product is introduced into cylinder 23, rotor drive motor 36 is activated and rotor 40 is brought up to a predetermined speed of from 500 to 900 rpm. Product is then pumped through product supply conduit 101 and through inlet 28. As is best shown in FIG. 3, the inlet 28 through the end cap 24 resides directly adjacent the inner surface of cylinder 23. Product introduced through inlet 28 is applied to the rapidly rotating inner wall of cylinder 23. The centrifugal force created by the rotation of cylinder 23 causes the pigment to cling to the inner surface of cylinder 23 and to be flattened against it. At this point in the process, pressure has not yet been applied to blades 70–78. Since cylinder 23 is tilted in the discharge direction, the pigment begins flowing toward the discharge end. When the inner wall of cylinder 23 has been completely coated with the pigment, pressure is applied to blades 70–78 by blade pressure pump 108. Fluid pressure is transmitted through hollow shaft 33, fluid pressure port 83/84, port 94 into pressure chamber 95. Blades 70–78 are simultaneously urged outwardly against the inner wall of cylinder 23. As is shown in FIG. 8, the direction of rotation is clockwise, whereby the gradually curved forward surface of blades 70–78 engage the thin coating of pigment on the inner wall of cylinder 23. A shearing force on the pigment is created at the apex of the blade along its length at the point of contact with the inner wall of cylinder 23. Blades 70–78 wipe the pigment along the inner wall of cylinder 23, allowing only those particles of pigment which have been reduced to their desired size to pass beneath the blade. The pressure on blades 70–78 required to reduce an agglomerate to a desired particle size must be determined empirically by comparing the particle size of the product output with the pressure on blades 70–78. As the product is ground, it is also moved toward the discharge end of grinding tank 11. This movement is caused by the tilt of grinding tank 11 toward the discharge end and the angle of articulation of the blades 70–78 in relation to the axis of rotation of rotor 40. Assuming a grinding time of one minute and a rotor rotation speed of 400 rpm, the track of a single particle of pigment through cylinder 23 from inlet 28 to the discharge end would theoretically define a spiral having approximately 400 turns. By adjusting the degree of tilt of grinding tank 11, the amount of time required for product to pass completely through cylinder 23 can be varied.

As is apparent from the foregoing, the pigment is applied to the inner wall of cylinder 23 in a thin film. Accordingly, heat distribution through the pigment is extremely even. Heat dissipated from the pigment through the walls of cylinder 23 and carried away by coolant water therefore results in the ability to maintain a high degree of temperature control over the pigment. The various operating parameters of grinding tank 11 can be changed substantially depending upon the product being ground. Cooling can be controlled by increasing the flow rate of the water or by reducing the temperature of the water as it is introduced into water jacket 12. Also, the speed of rotation of rotor 40 can be controlled to regulate heat, as can the pressure exerted on the pigment or other product by blades 70–78. As is shown in FIG. 1, the ground product runs out of the discharge end of cylinder 23 and into a suitable container. Ordinarily, the optimum grind would be established by determining the pressure at which blades 70–78 ground the pigment to the appropriate size. Then the tilt of grinding tank 11 would be adjusted to optimize the flow rate of the product. Then, water flow, temperature and rotor speed would be adjusted to control the product temperature.

Ordinarily, the blade pressure on the cylinder 23 will vary between 100 and 300 psi depending upon the fineness desired in the end product and the composition of the product being ground. If hydraulic pressure through hydraulic hose 102 is lost, blades 70–78 are automatically retracted by retract spring 92.

The grinding mill described above provides continuous throughput of product at a relatively high output rate. Efficient cooling is achieved by applying the product evenly in a thin film across the grinding surface. Because the product is exposed to a relatively small surface area of contact, cleaning is relatively easy so the grinding mill can be used for different substances and colors with a quick turn-around time. A very even particle size is achieved because of the uniform pressure which can be exerted on the cylinder 23 by the blades 70–78.

A grinding mill is described above. Various details of the invention may be changed without departing from its scope. Furthermore, the foregoing description of the preferred embodiment of a grinding mill according to the present invention is provided for the purpose of illustration only and not for the purpose of limitation —the invention being defined by the claims.

I claim:

1. An apparatus for reducing agglomerates to a predetermined particle size, comprising:

(a) a tank defining an uninterrupted cylindrical inner wall having a smooth surface for carrying thereon a coating of agglomerates, said tank having a material inlet and a material outlet;

(b) a rotor rotatably mounted in said tank for relative concentric rotation therein;

(c) a plurality of elongate rotor blades carried on said rotor for rotation therewith, each blade defining a tangential forward surface for shearing contact with the layer of agglomerates coating the inner wall of said tank; and (d) pressure responsive means for varying the distance between the tangential forward surface of said blades and the inner wall of said tank to thereby control the size to which the agglomerates are reduced, wherein each of said rotor blades is carried on its respective rotor by means of a rotor blade holder carried on said rotor, each of said rotor blade holders comprising an elongate body having an elongate slot therein adapted to receive one of said blades and hold said blade with the forward surface of said blade projecting outwardly toward the inner wall of said tank, wherein said pressure responsive means comprises:

(i) a source of hydraulic pressure;

(ii) at least one piston carried for restricted inward and outward movement in a suitable sized piston bore in said blade holder and responsive to pressure from said pressure source for outward movement of the blade towards said agglomerate coated wall and into contact with said agglomerate, and opposite inner movement of said blade away from said agglomerate coated wall; and (iii) biasing means for normally urging said blade inwardly away from said agglomerate coated wall and comprising a retract bolt secured to said blade and slidably positioned in a suitably sized through-bore in said piston, an enlarged head on the end of said retract bolt remote from said blade and a retract spring carried by said bolt and normally urging said bolt, and the blade fixedly secured thereto away from contact with said inner wall.

2. An apparatus for reducing agglomerates to a predetermined particle size according to claim 1, wherein said biasing means comprises a spring support stationarily secured to a suitably sized seat in said piston bore in spaced-apart relation to said piston and a Belville washer positioned in compressed relation between said spring support and the enlarged head of said washer for normally urging said bolt, and said blade secured thereto away from contact with said inner wall.

3. An apparatus for reducing agglomerates to a predetermined particle size according to claim 2, wherein said pressure responsive means includes a hydraulically sealed pressure chamber intermediate said piston and said spring support and fluidly communicating with said hydraulic system whereby hydraulic pressure within said pressure chamber urges said piston outwardly against said blade.

4. An apparatus for reducing agglomerates to a predetermined particle size according to claim 3, wherein said source of hydraulic pressure communicates with said hydraulically sealed pressure chamber through a fluid pressure port defined by interior walls in and along the length of said rotor.

5. An apparatus for reducing agglomerates to a predetermined particle size according to claim 1, wherein said rotor defines three longitudinally extending sides, and further wherein three blades are carried on each of said three rotor sides.

6. An apparatus for reducing agglomerates to a predetermined particle size according to claim 5, wherein movement of each of said blades is controlled by at least two pistons positioned in spaced-apart relation in two piston bores on each of said blade holders.

7. An apparatus for reducing agglomerates to a predetermined particle size according to claim 1, wherein said tank is pivoted for tilting movement around a point intermediate the opposing ends of said tank.

8. An apparatus for reducing agglomerates to a predetermined particle size according to claim 7, wherein said rotor is rotated by means of a hydraulic motor.

* * * * *